US010530090B2

(12) United States Patent
Wolff et al.

(10) Patent No.: US 10,530,090 B2
(45) Date of Patent: Jan. 7, 2020

(54) HOLDING FRAME FOR A PLUG CONNECTOR AND METHODS OF POPULATING SAME

(71) Applicant: HARTING Electric GmbH & Co. KG, Espelkamp (DE)

(72) Inventors: Hanno Wolff, Rahden (DE); Jörg Ziegenhahn, Büren (DE); Heiko Meier, Minden (DE); Andre Tiemann, Bad Essen (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/312,697

(22) PCT Filed: Jun. 22, 2017

(86) PCT No.: PCT/EP2017/065431
§ 371 (c)(1),
(2) Date: Dec. 21, 2018

(87) PCT Pub. No.: WO2017/220736
PCT Pub. Date: Dec. 28, 2017

(65) Prior Publication Data

US 2019/0334278 A1 Oct. 31, 2019

(30) Foreign Application Priority Data

Jun. 23, 2016 (DE) ..... 10 2016 211 300
Apr. 20, 2017 (DE) ..... 10 2017 108 431

(51) Int. Cl.
*H01R 13/518* (2006.01)
*H01R 43/00* (2006.01)
(Continued)

(52) U.S. Cl.
CPC ..... *H01R 13/518* (2013.01); *H01R 13/506* (2013.01); *H01R 13/514* (2013.01); *H01R 43/00* (2013.01)

(58) Field of Classification Search
CPC .. H01R 13/518; H01R 13/514; H01R 13/506; H01R 43/00; H01R 9/2608; H01R 9/26
(Continued)

(56) References Cited

U.S. PATENT DOCUMENTS 3,559,813 A * 2/1971 Sosinski ..... H05K 7/02 211/89.01
3,576,520 A * 4/1971 Stauffer ..... H01R 9/26 439/716
(Continued)

FOREIGN PATENT DOCUMENTS

DE 10 2013 106 279 A1 12/2014
DE 10 2013 113 976 A1 6/2015
(Continued)

OTHER PUBLICATIONS

International Search Report and Written Opinion, dated Sep. 13, 2017, for International Application No. PCT/EP2017/065431, 10 pages (with English translation of Search Report).

*Primary Examiner* — Gary F Paumen
(74) *Attorney, Agent, or Firm* — Seed IP Law Group LLP

(57) ABSTRACT

A holding frame comprising a base frame and at least two flange parts which are attached to the base frame opposite each other is proposed, in which each flange part extends outside the base frame along an outer face of the base frame in an insertion direction, around a lower edge of the base frame, inside the base frame along an inner face of the base frame in the opposite direction to the insertion direction and beyond an edge of the base frame in the opposite direction to the insertion direction, wherein each flange part has at least one latching window, in the region extending beyond
(Continued)

the edge of the base frame, as a latching element for receiving a latching lug of the module to fix the module in the holding frame.

17 Claims, 7 Drawing Sheets

(51) Int. Cl.
*H01R 13/514* (2006.01)
*H01R 13/506* (2006.01)

(58) Field of Classification Search
USPC ..... 439/716, 532
See application file for complete search history.

(56) References Cited

U.S. PATENT DOCUMENTS 4,090,764 A * 5/1978 Malsby ..... H01R 13/514 439/471
5,643,014 A * 7/1997 Filus ..... H01R 13/518 439/680
5,816,854 A * 10/1998 Baggett ..... H01R 9/2608 439/540.1
6,004,162 A * 12/1999 Harting ..... H01R 13/518 439/532
6,371,788 B1 * 4/2002 Bowling ..... H01R 13/518 439/358
7,316,591 B2 * 1/2008 Ferderer ..... H01R 13/506 439/532
7,488,202 B2 * 2/2009 Spitaels ..... H01R 13/741 439/532
9,608,374 B2 * 3/2017 Beischer ..... H01R 13/514
2007/0155252 A1 * 7/2007 Ferderer ..... H01R 13/506 439/680
2016/0093980 A1 3/2016 Beischer et al.
2016/0285194 A1 9/2016 Herbrechtsmeier
2017/0237209 A1 * 8/2017 Loetkemann ..... H01R 13/518 439/540.1
2018/0131131 A1 * 5/2018 Pathmanathan ..... H01R 13/506

FOREIGN PATENT DOCUMENTS

EP 0 860 906 B1 5/2004
EP 1 801 927 B1 5/2010
EP 2 581 991 A2 4/2013
WO 2015/085995 A1 6/2015

* cited by examiner

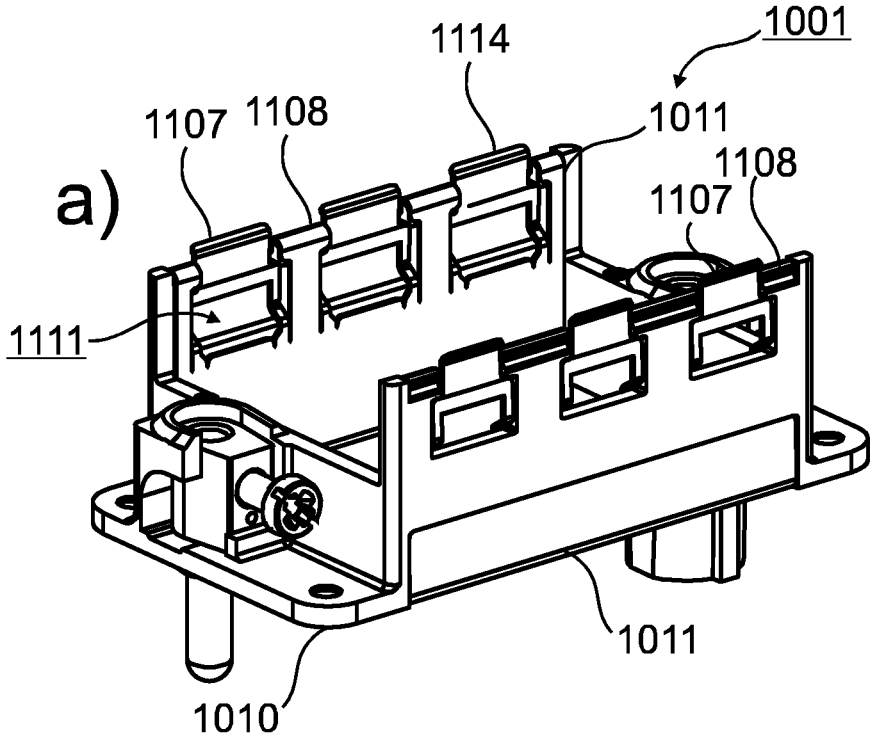
Fig. 7
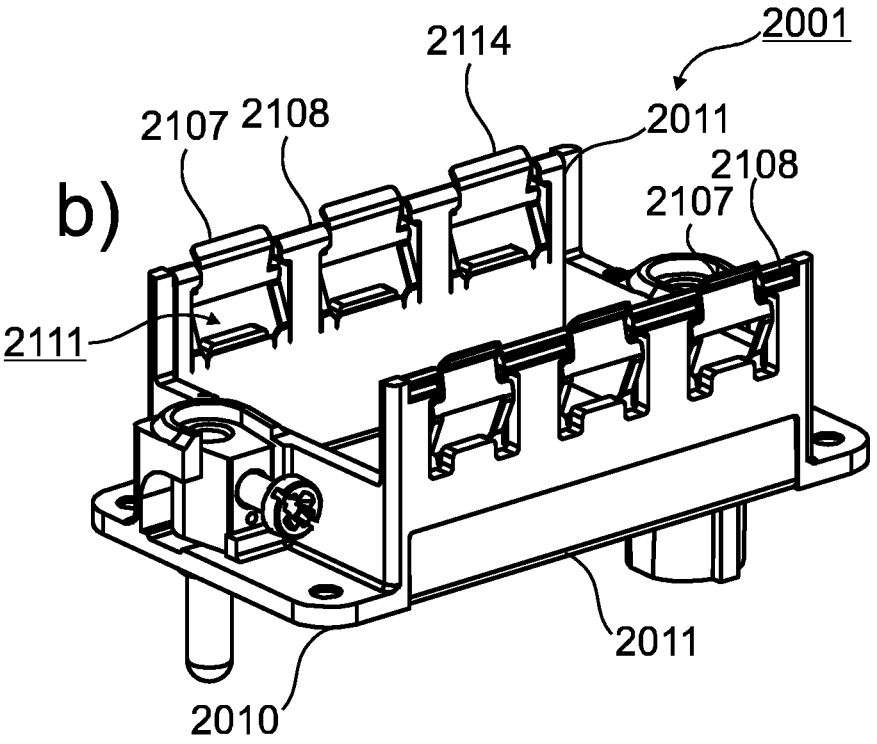

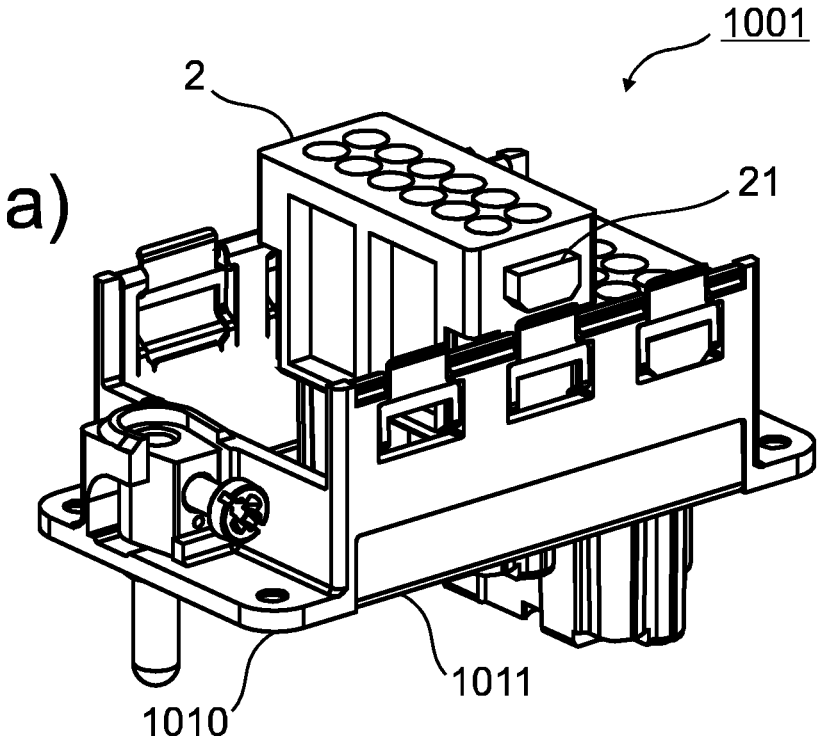
Fig. 8
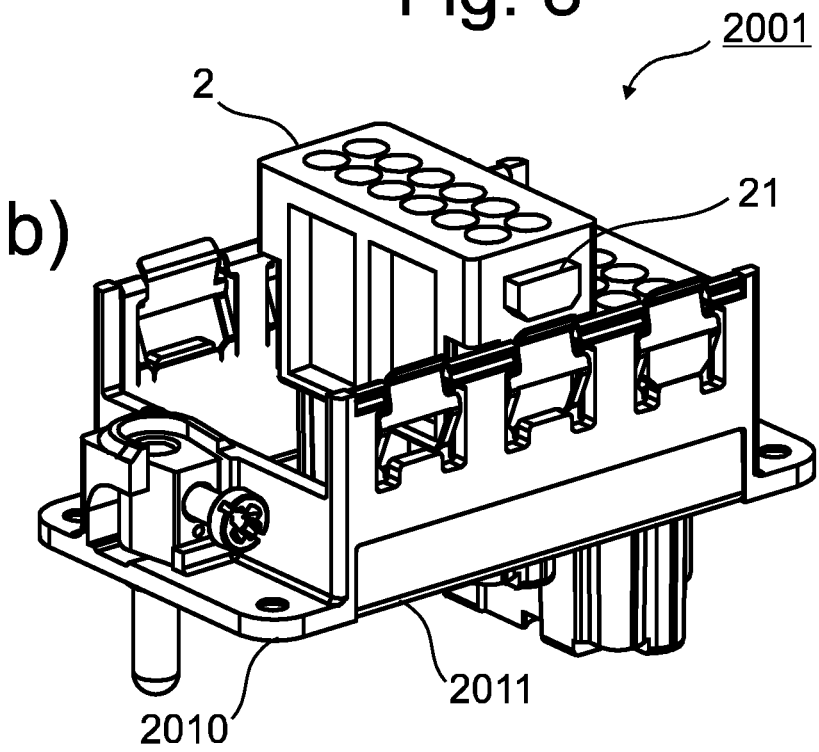

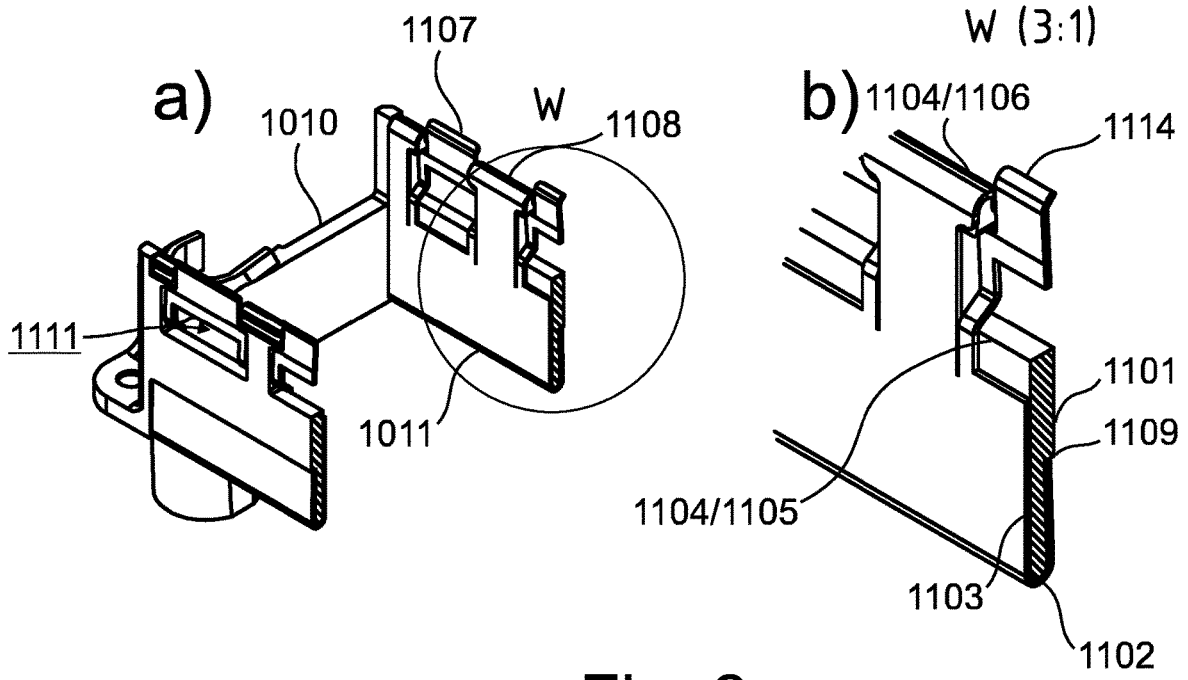
Fig. 9
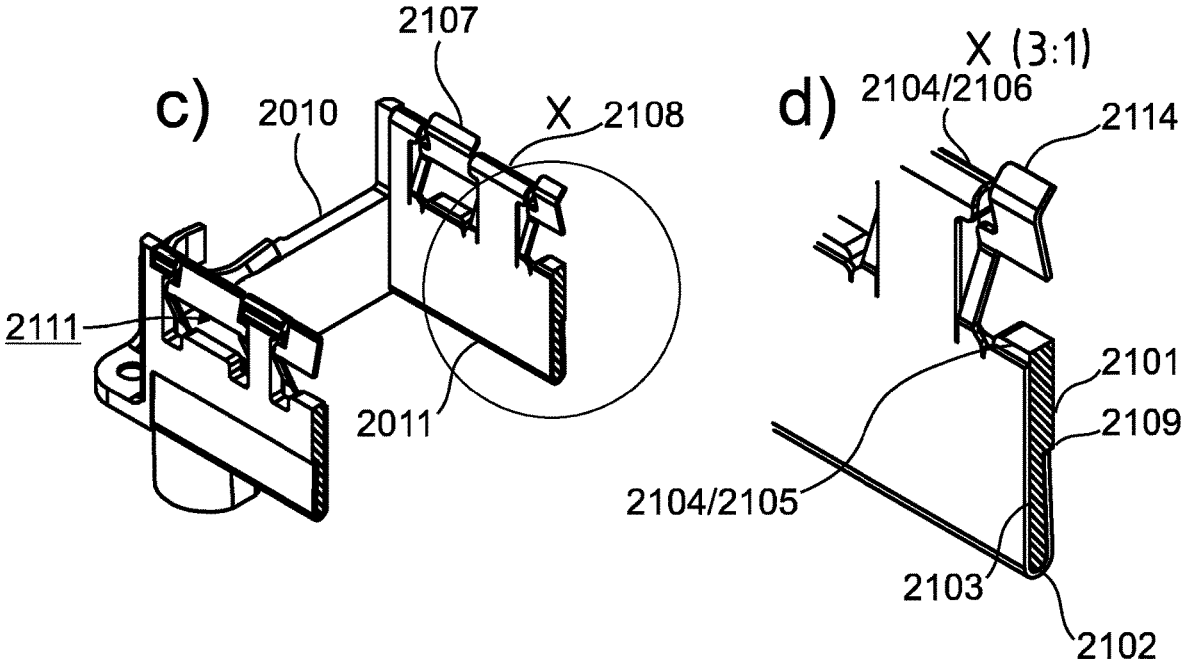

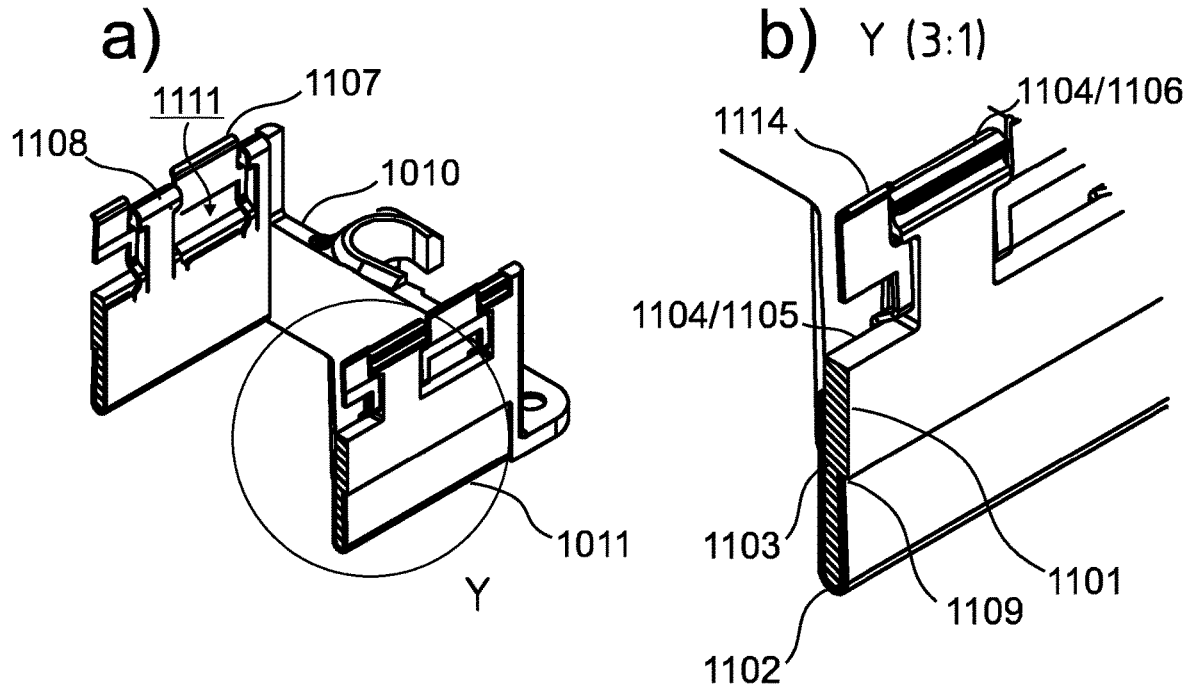
Fig. 10
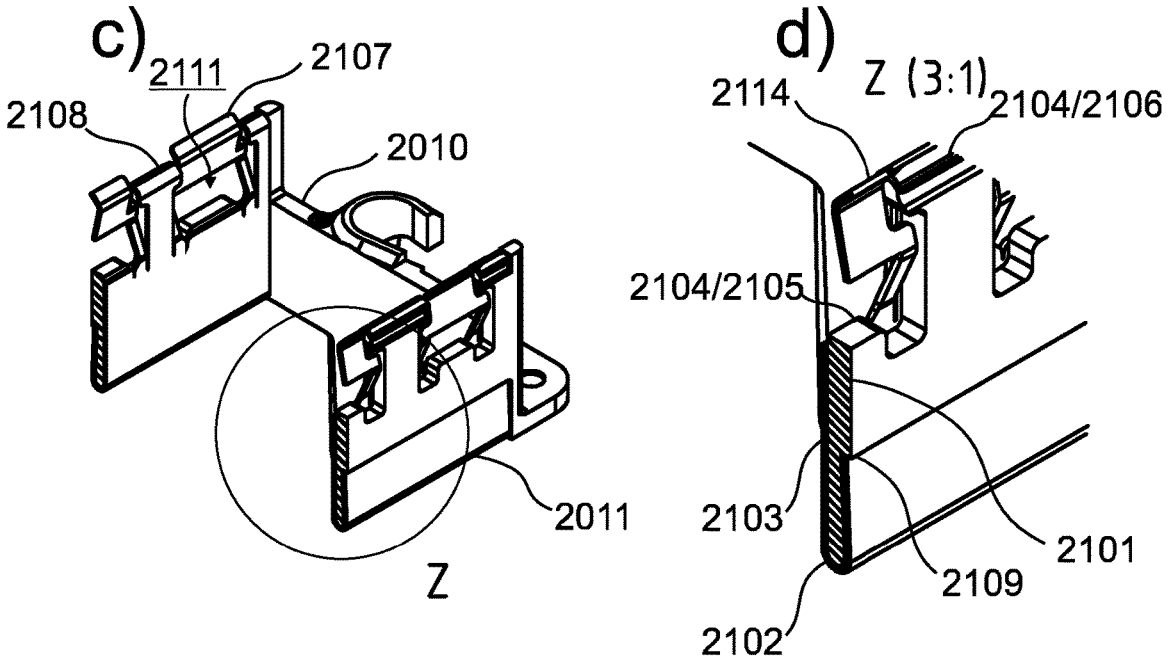

HOLDING FRAME FOR A PLUG CONNECTOR AND METHODS OF POPULATING SAME

BACKGROUND

Technical Field

The present disclosure relates to the field of holding frames for modules and in particular of holding frames for a plug connector for receiving similar and/or different modules.

Description of the Related Art

Holding frames are used to accommodate a plurality of similar and/or different modules. These modules may be insulating bodies, for example, which are provided as contact holders for electronic and electrical and possibly also for optical and/or pneumatic contacts.

A holding frame for holding plug connector modules and for installing in plug connection casings or for screwing onto wall surfaces is known from document EP 0 860 906 B1, wherein the plug connector modules are inserted into the holding frame and holding means on the plug connector modules cooperate with recesses provided on opposite wall parts (side parts) of the holding frame, wherein the recesses in the form of openings which are bounded on all sides are provided in the side parts of the holding frame, wherein the holding frame consists of two halves articulatedly connected to each other, wherein the holding frame separates along a line which is parallel to the side parts of the holding frame, and wherein hinges are arranged in fastening ends of the holding frame in such a way that when the holding frame is screwed onto a fastening surface, the frame parts are oriented in such a way that the side parts of the holding frame are oriented at right angles to the fastening surface and the plug connector modules are connected interlockingly to the holding frame by means of the holding means. In practice, such holding frames are normally made in a die casting process, and more particularly in a zinc die casting process.

Document EP 2 581 991 A1 discloses a holding frame for plug connector modules, comprising two frame halves which can be latched to each other by linear displacement of the one frame half relative to the other frame half in a sliding direction, wherein mutually corresponding latching means are provided on the frame halves and cause the two frame halves to latch into each other in two different latching positions during linear displacement, in which the frame halves are spaced from each other at different distances.

Practice has shown, however, that assembling such holding frames is a time-consuming operation. For example, such holding frames have to be screwed and/or latched out of the plug connector as soon as just one single module needs replacing. It is possible that the other modules, whose removal is not at all desired, could fall out of the holding frame and have to be inserted again before the frame halves are screwed together again and/or before the frame halves latch together. Before the frame halves can be joined, all the modules must simultaneously be in the position provided for them, so that they can finally be fixed in place in the holding frame when the frame halves are joined together. This makes assembly more difficult.

Document EP 1 801 927 B1 discloses a holding frame consisting of an integral injection-molded plastic part. The holding frame is formed as a circumferential collar and on its mating side has a plurality of wall segments which are separated by slits. A respective pair of opposite wall segments form an insertion region for a plug-in module, the wall segments having window-like apertures for receiving projections integrally molded with the narrow sides of the modules. A guide groove is also provided in each of the wall segments. The guide groove is formed above the apertures by means of an outwardly offset window web which has an insertion bevel on the inner surface. The plug-in modules also have latching arms integrally molded on the narrow sides, which act in the direction of the cable connectors, and which latch into place under the lateral collar wall, so that two independent latching means fix the plug connector module in the holding frame.

One disadvantage of this prior art is that it is a holding frame made of plastic, which is generically unsuitable for protective earthing according to the EN 61984 standard for connectors, which therefore means that such a holding frame cannot be used for installation in metal plug connector casings. The use of metal plug connector casings requires such protective earthing, however, and in many cases is necessary and therefore desired by customers because of the mechanical robustness, temperature resistance and electrical shielding properties of such casings. It has also been found that manufacturing the aforementioned plastic holding frames by injection molding is difficult at the least and can only be achieved with great effort and expenditure. Finally, the heat resistance of such a plastic holding frame is not always sufficient for special applications, either, for example near a blast furnace.

In order to specify a structural design for a holding frame which has good heat resistance and high mechanical robustness and which allows protective earthing, also and in particular when installed in a metal plug connector casing, and which also ensures ease of operation, especially when replacing individual modules, document DE 10 2013 113 976 A1 proposes providing a base section (preferably die cast and made of zinc or aluminum or an appropriate alloy, for example) for fixing a received module in a plane, and a deformation section (preferably a die formed resilient metal sheet) which can adopt an insertion state and a holding state, the insertion state allowing at least one module to be inserted into the holding frame in a direction transverse to the plane, and a received module being fixed in place in the holding state. The base section and the deformation section are formed at least partly of different materials, in any case.

By dissociating the material properties of the base body from those of the deformation section, such a holding frame allows greater flexibility by using suitable combinations of materials.

In the holding frames described in DE 10 2013 113 976 A1, each deformation section is formed by flange parts attached to the outer face of a base frame, the flange parts each having a bending line in their lower end region, at which the flange parts are folded by 180° such that a final edge of the respective flange part is located within the base frame. In order to attach the flange part, the base frame has outer attachment studs with engage into matching attachment recesses when a flange part is attached.

It has been found that, when bending open the flange parts to insert one or more modules, a force acts on the arrangement of attachment studs and attachment recesses that may cause the attachment recesses to be released from the attachment studs, and that this, in combination with the force acting on the flange part in the insertion direction may result in the flange part being displaced such that the attachment recesses are offset in relation to the attachment studs, with the consequence that the module or modules are no longer fixed securely in place.

It is also desired that an inserted module can be fixed in place more tightly, so that the holding frame as a whole is more resistant against a module being inadvertently released from the holding frame.

BRIEF SUMMARY

One aim of embodiments of the present invention is to provide a holding frame which achieves some or all of the advantages associated with the teaching of document DE 10 2013 113 976 A1, but which also achieves a high degree of fixing reliability and stability.

It is therefore desired that a solution be provided which allows a high degree of flexibility in the design of the holding frame, by appropriately selecting the materials for a base frame and flange parts largely independently of each other, and which reduces the probability that the base frame and flange parts formed separately of different materials can detach from each other or that the holding effect of the flange parts is limited or reduced in some other manner.

According to a first aspect of the invention, a holding frame for a plug connector for receiving similar and/or different modules is proposed, the holding frame comprising a base frame which defines a plane transverse to an insertion direction of a module into the holding frame, and at least two flange parts which are attached to the base frame opposite each other, wherein each flange part extends outside the base frame along an outer face of the base frame in the insertion direction, around a lower edge of the base frame, inside the base frame along an inner face of the base frame in the opposite direction to the insertion direction and beyond an edge of the base frame in the opposite direction to the insertion direction, wherein each flange part has at least one latching window, in the region extending beyond the edge of the base frame, as a latching element for receiving a latching lug of the module, wherein the flange parts are designed to undergo elastic bending and deformation between an insertion state which allows the module to be inserted into the holding frame in the insertion direction, and a holding state in which an inserted module is fixed in place at least along the insertion direction by the latching lug engaging into the latching window.

According to a second aspect of the invention, a method is proposed for populating a holding frame for a plug connector for receiving similar and/or different modules with a module, said method comprising inserting the module into a base frame which defines a plane transverse to an insertion direction of the module, wherein the module is inserted between at least two flange parts which are attached to the base frame opposite each other, wherein each flange part extends outside the base frame along an outer face of the base frame in the insertion direction, around a lower edge of the base frame, inside the base frame along an inner face of the base frame in the opposite direction to the insertion direction and beyond an edge of the base frame in the opposite direction to the insertion direction, wherein each flange part has at least one latching window, in the region extending beyond the edge of the base frame, as a latching element for receiving a latching lug of the module, wherein insertion includes elastic bending of the flange parts, which are supported by the base frame, into an insertion state, wherein the method includes elastic deformation of the flange parts back from the insertion state to a holding state, wherein the inserted module is fixed in the holding state at least along the insertion direction by the latching lug engaging into the latching window.

Part of the background to embodiments of the present invention can be found in the following considerations.

In order to better prevent an offset arising between an attachment stud and a recess, in an arrangement of the kind shown in document DE 10 2013 113 976 A1, the stud and the recess could be fixed to each other by suitable additional measures, for example by gluing or soldering them together. However, this does not allow fixing by the flange parts to be made tighter as such, and also makes it more complicated to make the holding frame, due to the additional step, which thus entails higher costs.

If the arrangement comprising an attachment stud and an attachment recess, or a similar variant based on the teaching of document DE 10 2013 113 976 A1, were to be moved to the inner face of the base frame, this would prevent the arrangement from being released when the flange parts are opened out, but the result would be a worsening of the fixing tightness, because the flange parts would be even easier to bend due to the longer lever arm (namely as far as the lower edge of the holding frame). In such a variant, a load would also be placed on the region of the flange parts that is bent around the lower edge of the holding frame. When manufacturing by die forming, in particular, material fatigue and thus the failure of the flange parts can be expected to occur more quickly in this region at the lower edge of the holding frame under repeated stress.

On the other hand, tighter fixing in place—with the dimensions of holding frame otherwise being substantially the same—might be achievable by making the flange parts from a stiffer material and/or with a greater material thickness, although that would mean greater effort and expense when producing the flange parts, for example by die forming.

The inventor realized that greater stability and better fixing of modules in place can be achieved by arranging the flange parts in such a way that they extend on the inner face of the base frame and from there in the opposite direction to the direction in which the modules are inserted. When the flange parts are bent open on insertion of a module, the pivot point or bending point is on the (upper) edge of the base frame and no longer at an arrangement of attachment studs and recesses, or even at the lower edge that has previously been already deformed. Due to the flange part being supported by the base frame when it is being bent open, the amount of spring deflection is kept as short as possible. By its presence, the module being inserted also counteracts the flange part being lifted off the inner face of the base frame, with the result that, if so provided, an arrangement similar to the attachment studs and matching attachment recesses known from the teaching of document DE 10 2013 113 976 A1 can also be provided on the inner side, without involving any risk of detachment due to deformation of the flange parts.

As the respective module is guided and held by the flange parts, the base frame can also be made shorter by comparison (in the insertion direction). The base frame now holds the flange parts which then hold the modules.

Advantageously, the modules may be received and fixed in place only by the flange parts, which act as spring arms and which are arranged for greater stability and spring force on the inner face of the frame, as a result of which the flange parts have a shorter spring deflection by comparison, thus making the construction "tighter".

The stability is additionally increased by the resilient region of the flange parts being inside the base frame.

Furthermore, the pivot and bending point of the material is not in the lower region that is already deformed plastically, but in the middle of the flange part. This region does not suffer from material fatigue as quickly as the region that is already plastically deformed (bent).

In one advantageous embodiment of one aspect of the invention, the base frame, on the one hand, and the flange parts, on the other hand, are made at least partly of different materials. It is not necessary, but advantageous, if the base frame is made (entirely or at least partly) of a different material from that of the flange parts. However, it is also possible that the base frame is made (at least substantially) of the same material as the flange parts, the flange parts typically having a smaller cross-section, with the result that the holding frame as a whole has a rigidity and stability due to the base frame with the larger cross-section and hence the greater stiffness, whereas the flange parts are designed to be resilient.

In another advantageous embodiment of one aspect of the invention, the base frame is made at least partly by die casting, in particular of a metal, preferably of zinc or aluminum, or of a metal alloy, preferably of a zinc or aluminum alloy. Producing such a base frame is known, albeit with different contours when viewed in detail, from the context of known holding frames. Such prior art techniques can also be deployed advantageously, with appropriate adjustments, for the holding frame and its base frame according to aspects of the invention.

In another advantageous embodiment of one aspect of the invention, the flange parts have or consist of a resilient metal plate and are preferably made at least partly by die forming. The use of die forming, in combination with a resilient metal plate, allows flange parts which can be used in the present invention to be produced inexpensively. Formation of the latching windows, any slots, and any recesses or the like for attaching the flange parts to the base frame, are simple to produce.

In another advantageous embodiment of one aspect of the invention, the flange parts are attached form-fittingly, force-lockingly and/or by material bonding to the inner face and/or to the outer face of the base frame, in particular by bonding, welding, soldering, riveting, snap-locking and/or screwing. Since the force that acts when the flange parts are bent open to insert one or more modules is substantially limited to the region of the flange parts projecting beyond the edge of the base frame, and a partly inserted module may itself prevent any undesired deformation of the flange parts, the join between the flange parts and the base frame can be selected substantially freely. It is particularly advantageous to attach the flange parts form-fittingly by latching, where a part of a flange part engages into a recess or the like in the base frame and/or a projection or the like engages into a window, a hollow or the like in the flange part. Part of the form fit is already achieved by the flange part engaging around the lower edge of the base frame, so it suffices if the latching merely prevents the flange part from moving relative to the base frame in the insertion direction. The advantage of latching is that it minimizes the steps needed for assembly, but at the price of having to provide the appropriate geometry. Attachment is preferably on the outer face of the base frame.

In another advantageous embodiment of one aspect of the invention, each flange part has at least one slot extending in the insertion direction, which separates two flaps of the flange part from each other in at least part of the region extending beyond the edge, each flap having at least one latching window as a latching element for receiving a latching lug of the module. It is possible to provide a separate pair of flange parts for each module to be inserted, each one of which having a latching window. Inserting a module into the holding frame or releasing a module from the holding frame (which is essentially the reverse of insertion) can then be done independently of adjacent modules or flange parts. If a flange part is provided with one or more suitably dimensioned slots, the module can likewise be inserted or removed separately for each flap that is separated from a neighboring flap by the slot.

In a particularly advantageous variant of the above embodiment, the slot extends into the region of the flange part that extends along the inner face of the base frame. When the slot extends into the interior space defined by the base frame, the flaps are formed above the edge of the base frame independently of one another as far as possible.

In another advantageous embodiment of one aspect of the invention, the holding frame has at least four flange parts, each two of which are attached adjacently to each other to one side of the base frame. Even though it is possible to provide a separate pair of flange parts for each module being inserted, each one of which having a latching window, it is equally possible that, although a plurality of flange parts is provided on the opposite sides of the base frame or holding frame, one flange part is provided for one module and/or for a plurality of modules.

In another advantageous embodiment of one aspect of the invention, at least one flange part has a guide portion, in particular at the end of the flange part or at the latching window, which allows the module to be guided for centering between the opposite flange parts when the module is being inserted and/or along which the latching lug of the module is guided on insertion, in order to deform the flange part into the insertion state. The guide portion improves the ease of handling for the user, because the user only needs to bring the module being inserted between the guide portions or between the one guide portion and the opposite flange part, with further insertion produced by exerting a force in the insertion direction causing the gap to be widened. This means that the user does not need to take any steps in order to spread the flange parts apart. The same also applies in the case of automatic populating, which can thus be made more simple.

In another advantageous embodiment of one aspect of the invention, at least the region of each flange part extending along the inner face of the base frame is designed to contact the inserted module at least partly to fix it in place between the opposite flange parts.

In a particularly advantageous variant of the above embodiment, at least the region of each flange part extending along the inner face of the base frame has a spring portion, which is designed to contact the inserted module and to exert pressure in the direction of the inner face of the base frame. It is also possible that just one of the opposite flange parts has one or more such spring portions for pressing the inserted module against the opposite flange part, and it is also possible that the flange parts have spring portions that alternate or a mixed in some other manner, in which case it is preferable that only one spring portion per module is provided.

In another particularly advantageous variant of the above embodiment, at least the region of each flange part extending along the inner face of the base frame is designed to contact the surface of the inserted module continuously in the insertion direction. If the faces of the module each contact the flange parts continuously in at least one portion, this itself results in a spatial limitation that prevents any undesired offset on the part of the module.

In another advantageous embodiment of one aspect of the invention, each flange part has one or more latching window regions extending beyond a latching window portion of the edge of the base frame and having the at least one latching window, and one or more holding regions, each extending around a clasping portion of the edge of the base frame and fixing the flange part form-fittingly to the base frame.

With a combination of latching window regions that are each bent elastically on insertion of the module, and holding regions extending around part of the edge of the base frame, the flange parts allow modules to be inserted into and securely held in the holding frame, while the flange parts themselves are securely attached form-fittingly to the base frame, this secure fixing being achieved by elements of the flange parts engaging around opposite edges or edge portions.

In a particularly advantageous variant of the above embodiment, the clasping portion of the edge of the base frame is spaced further apart in the insertion direction from the lower edge of the base frame than the latching window portion of the edge of the base frame.

In this variant, when modules are being inserted the base frame extends into the regions between the latching lugs of the modules, such that the base frame acts here as an additional guide for the modules when they are being inserted. In this way, the flange parts that are bent during insertion of the modules can be exempted from performing guiding functions themselves. The stiffness of the base frame protects the bendable parts of the flange parts against damage caused by incorrect insertion of a module.

In another advantageous embodiment of one aspect of the invention, the flange parts are designed such that the holding frame does not exceed a total predetermined width at least in a region from its lower edge to a predetermined height, in particular to beyond the latching window, also when the flange parts are in the insertion state, wherein the total predetermined width is equal in particular to the total width of the holding frame below the latching window.

The flange parts are bent outwards in the latching window region, and it is possible, by designing the flange parts appropriately and advantageously, particularly in the region from the edge of base frame, including webs or the like in the flange parts around the respective latching window, to ensure that any free space that is available, for example due to installation in a mounting casing, is not exceeded even in the insertion state. Mounting a module in the holding frame is thus possible even when the holding frame is in an installed state.

In another advantageous embodiment of one aspect of the invention, each outer face of the base frame has a step, in particular such that the outer surfaces of the flange parts extending outside the base frame along the outer face of the base frame are aligned with a respectively exposed outer surface of the base frame, or the outer surfaces of the flange parts extending outside the base frame along the outer face of the base frame are offset in the direction of the interior of the base frame relative to the respectively exposed outer surface of the base frame.

The base frame provided with such a step can also be described as being provided with a recess on the outer face for receiving the flange part. With the step or recess, it is possible to avoid any widening of the holding frame as a whole due to the flange parts engaging around the lower edges of the base frame, the step preferably being dimensioned such that the flange part ends at the outer face of the base frame.

Features of advantageous embodiments of the invention are also defined in the claims, in particular, and a person skilled in the art can also find other advantageous features, embodiments and variants of the invention in the above description and the discussion below.

BRIEF DESCRIPTION OF THE SEVERAL VIEWS OF THE DRAWINGS

In the following, aspects of the present invention shall be illustrated and described with reference to the embodiments shown in the figures.

FIGS. 7*a* and 7*b* show schematic views of a fourth and a fifth embodiment of a holding frame according to the invention, respectively.

FIGS. 8*a* and 8*b* show schematic views of the holding frames from FIGS. 7*a* and 7*b*, with modules.

FIGS. 9*a*-9*d* show schematic cross-sectional views of the holding frames shown in FIGS. 7*a* and 7*b*.

FIGS. 10*a*-10*d* show further schematic cross-sectional views of the holding frames shown in FIGS. 7*a* and 7*b*.

DETAILED DESCRIPTION

In the enclosed drawings and in the associated descriptions of said drawings, corresponding or related elements are given corresponding or similar reference signs, where expedient, even when they are to be found in different embodiments.

Figure 1:
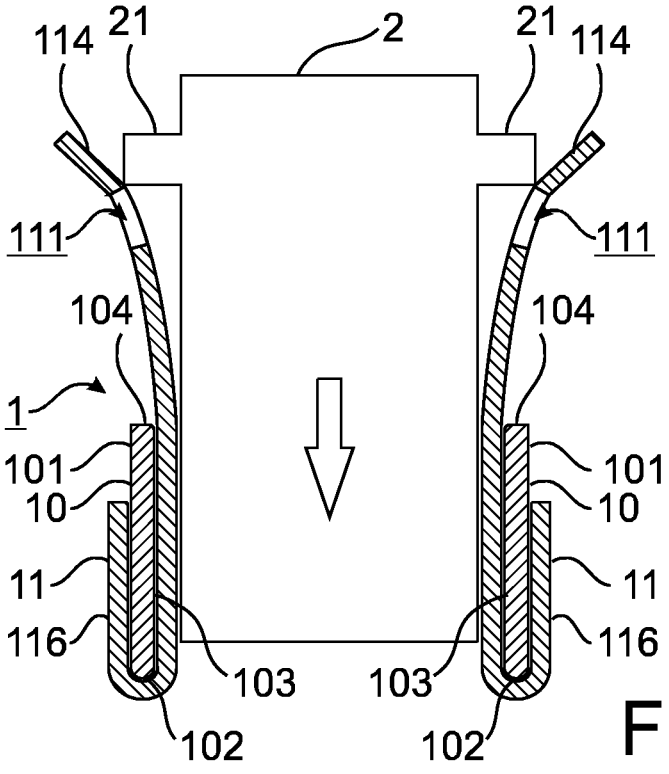
FIG. 1 shows a schematic cross-sectional view illustrating a first embodiment of the holding frame according to the invention, with a partially inserted module.

FIG. 1 shows a schematic cross-sectional view illustrating a first embodiment of the holding frame according to the invention, with a partially inserted module.

Holding frame 1 comprises a base frame 10 and flange parts 11 which are attached to base frame 10. Base frame 10 defines and encloses a plane transverse to an insertion direction of a module 2 (indicated by the large arrow in FIG. 1). Base frame 10 has a shape which is substantially determined by two opposite side walls (shown in cross-section in FIG. 1) and two opposite cross walls, whereby base frame 10 may have other parts (not shown) which can be used in a known manner to mount the base frame 10 on a wall, for example, or on other components of a plug connector (not shown) and/or for an earthing contact (not shown).

On each of its side walls, base frame 10 has an outer face 101, a lower edge 102, an inner face 103 and an edge 104.

A flange part 11 extends, with an outer portion 116 oriented in the insertion direction, on either side along the outer face 101 of base frame 10, around lower edge 102 and along inner face 103 of base frame 10. Flange part 11 also extends beyond edge 104 of base frame 10 from the inner face 103 thereof, in the opposite direction to the insertion direction. In its latter portion, flange part 11 has a latching window 111, followed by a guide portion 114 which is bent outwards in comparison with the rest of flange part 11.

Module 2 has a substantially rectangular cross-section, with two latching lugs 21 being formed on either sides of the module 2.

When module 2 is inserted into holding frame 1, latching lugs 21 slide along guide portions 114 and in the process spread flange parts 11 open, as shown in FIG. 1.

This spreading action causes flange parts 11 to bend outwards, with the bending of flange parts 11 commencing in the region of the edge 104 of base frame 10, such that only the part of flange parts 11 that extends beyond edge 104 is bent. When module 2 is already partially inserted, flange part 11 is spatially defined between base frame 10 and module 2 such that no bending or only very slight bending occurs here.

The relationship between flange parts 11 and module 2 also means that module 2 is held in place only by flange parts 11, whereas base frame 10 lends stability and stiffness to holding frame 1, as a whole, by holding flange parts 11 (and thus module 2 merely indirectly).

Figure 2:
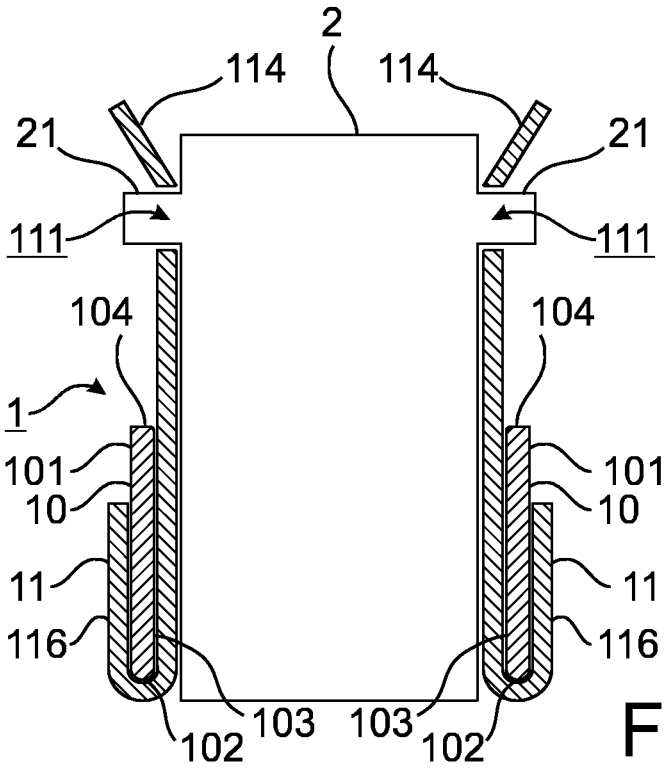
FIG. 2 shows a schematic cross-sectional view illustrating the first embodiment of the holding frame according to the invention, with an inserted module.

FIG. 2 shows a schematic cross-sectional view illustrating the first embodiment of the holding frame 1 according to the invention, with a module 2 inserted.

In comparison with the view shown in FIG. 1, module 2 has been inserted into holding frame 1, in the view shown in FIG. 2, with latching lugs 21 of module 2 extending through latching window 111 of flange parts 11, with the result that module 2 is fixed in place in holding frame 1. Flange parts 11 have returned to a relaxed state, because they are no longer spread apart at guide portions 114 by latching lugs 21. The outwardly pointing guide portions 114 allow a user to grab the ends of flange parts 11 and to spread flange parts 11 apart in order to remove the module 2 again—regardless of whether the flange parts 11 extend beyond the module 2 in the opposite direction to the insertion direction, as shown in FIGS. 1 and 2.

Figure 3:
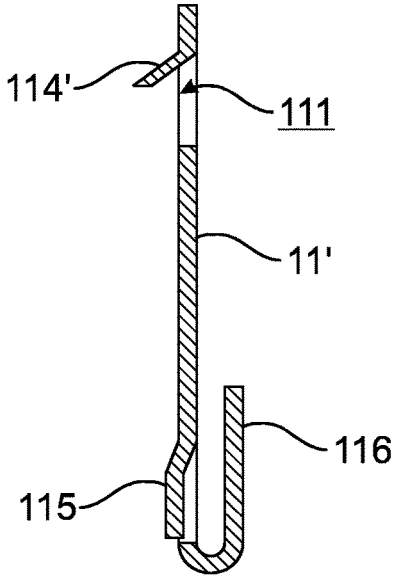
FIG. 3 shows a schematic cross-sectional view illustrating a flange part of a second embodiment of the holding frame according to the invention.

FIG. 3 shows a schematic cross-sectional view illustrating a flange part 11' of a second embodiment of the holding frame according to the invention.

Flange part 11' has the same basic shape as flange part 11 shown in FIG. 1 and FIG. 2. Like the latter, flange part 11' has an outer portion 116 (which extends in the installed state along the outer face of the side wall of the base frame—see FIG. 1 and FIG. 2) to which a bend and the inner portion adjoin, and which extends in the installed state beyond the edge of the base frame against the insertion direction.

Unlike flange part 11 shown in FIG. 1 and FIG. 2, flange part 11' has, in a part located inside the space defined by the base frame a spring portion 115 which exerts a force on an inserted module (not shown) towards the interior of the base frame (i.e., to the left in the view shown in FIG. 3). In the region of latching window 111, flange part 11' also has a guide portion 114' pointing inwards in the installed state, which can engage, for example, into a corresponding recess in a module above its latching lug.

Figure 4:
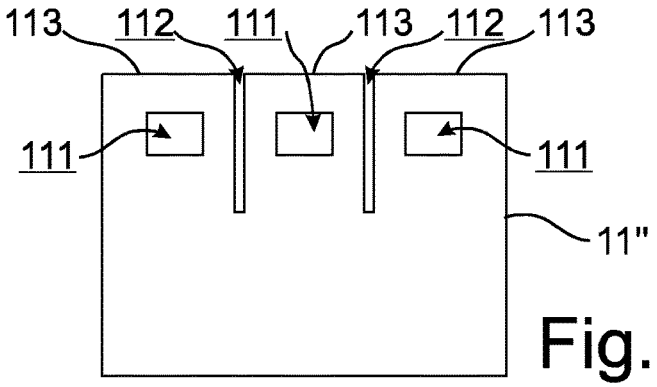
FIG. 4 shows a schematic view illustrating a flange part of a third embodiment of the holding frame according to the invention.

FIG. 4 shows a schematic view illustrating a flange part 11" of a third embodiment of the holding frame according to the invention.

Differently from the views shown in FIG. 1, FIG. 2 or FIG. 3, flange part 11" is shown in FIG. 4 in a view from the interior of the base frame in the installed state.

Flange part 11" has three latching windows 111, between which a slot 112 extends, such that flange part 11" has three flaps 113 that can be bent open substantially independently of each other.

Figure 5:
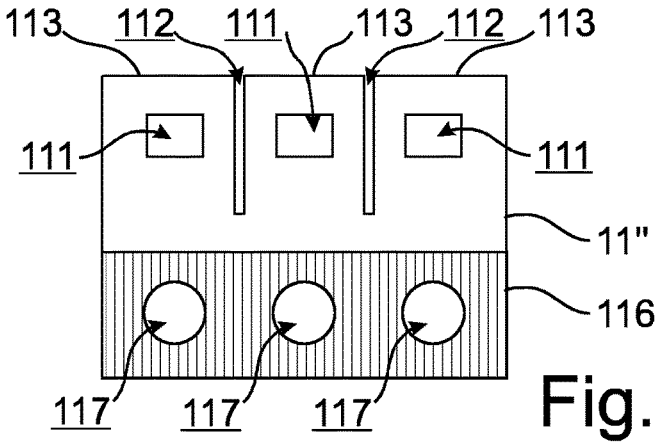
FIG. 5 shows a further schematic view illustrating the flange part of the third embodiment of the holding frame according to the invention.

FIG. 5 shows a further schematic view illustrating the flange part 11" of the third embodiment of the holding frame according to the invention.

In FIG. 5, flange part 11" is shown from the opposite side, so outer portion 116 (which was concealed in FIG. 4) can now be seen. Outer portion 116 has three attachment recesses 117, into which matching studs (not shown) on the base frame (not shown) engage in the installed state, thus resulting in interlocking fixing of flange part 11" on the base frame, as is described in similar form in document DE 10 2013 113 976 A1 for a known holding frame comprising a base frame and flange parts.

Figure 6:
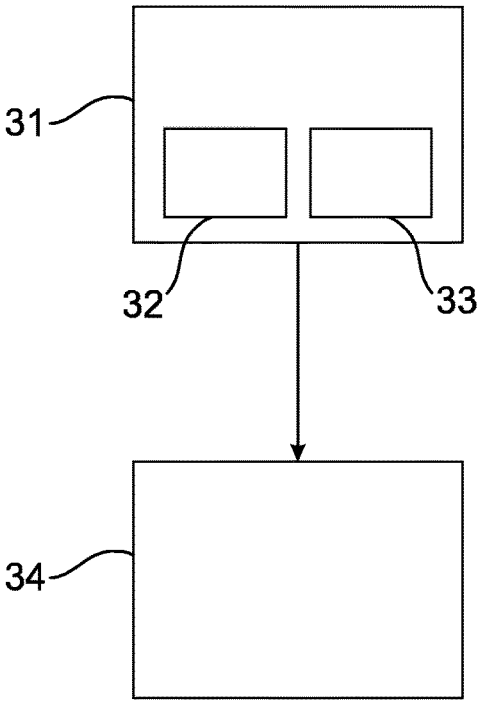
FIG. 6 shows a schematic flow diagram of an embodiment of the method of populating a holding frame with a module according to the invention.

FIG. 6 shows a schematic flow diagram of an embodiment of the method of populating a holding frame with a module according to the invention.

In the method, a holding frame according to the invention (see FIG. 1 and FIG. 2, for example) is populated with a module.

The method comprises inserting 31 the module into a base frame of the holding frame, or more precisely between flange parts, at least, which are held opposite each other by the base frame.

As shown in FIG. 1 and FIG. 2, each flange part extends outside the base frame along an outer face of the base frame in the insertion direction, around a lower edge of the base frame, inside the base frame along an inner face of the base frame in the opposite direction to the insertion direction and beyond an edge of the base frame in the opposite direction to the insertion direction.

In its region extending beyond the edge of the base frame, each flange part has at least one latching window as a latching element for receiving a latching lug of the module.

Insertion 31 includes elastic bending 32 of the flange parts, supported by the base frame, into an insertion state (see FIG. 1).

If the module has been inserted far enough, the flange parts are elastically restored 33 from the insertion state to a holding state (see FIG. 2).

The inserted module is thus fixed in the holding state, at least along the insertion direction, by engagement of the latching lug in the latching window (step 34).

FIGS. 7*a* and 7*b* show schematic views of a fourth (FIG. 7*a*) and a fifth (FIG. 7*b*) embodiment of a holding frame according to the invention. Details of this embodiment are illustrated in FIGS. 9*a*-9*d* and 10*a*-10*d*.

Holding frame 1001 according to the fourth embodiment comprises a base frame 1010 which is provided with a flange part 1011 on each of its longitudinal sides. Holding frame 2001 according to the fifth embodiment likewise comprises a base frame 2010 which is provided with a flange part 2011 on each of its longitudinal sides.

In the following, common or corresponding features of the fourth embodiment and of the fifth embodiment are jointly described, the respective statements applying to each of the embodiments unless a deviation therefrom is specified or obvious.

In their upper region (i.e., against the plug-in or insertion direction, see FIGS. 8*a* and 8*b*), flange parts 1011, 2011 each have latching window regions 1107, 2107 alternating with holding portions 1108, 2108. In these embodiments, three latching window regions 1107, 2107 are provided in each flange part 1011, 2011, and are distributed between four holding regions 1108, 2108. However, other numbers of latching window regions are also possible, depending on how many modules are to be accommodated by the holding frame. A smaller number of holding regions, in relation to the number of latching window regions, may also be provided, for example by leaving out the outer holding regions.

A latching window 1111, 2111 is provided in each latching window region 1107, 2107 of flange part 1011, 2011. In a manner that is known per se, latching windows 1111, 2111 opposite one another are designed with different sizes in order to define an unambiguous orientation for the modules being inserted (see FIG. 8), although latching windows 1111, 2111 and also the flange parts 1011, 2011 opposite one another may be identical to each other in the sense of rotational symmetry.

Above each latching window 1111, 2111 there is guide portion 1114, 2114 of the respective latching window region 1107, 2107, which comes into contact with a latching lug and is displaced by the latter on insertion of the modules (see FIGS. 8*a* and 8*b*), unless the latching window portion 1107, 2107 is bent in some other manner to bring the flange parts 1011, 2011 into their insertion state.

FIGS. 8*a* and 8*b* show schematic views of holding frames from FIGS. 7*a* and 7*b*, with modules 2.

In the views shown in FIGS. 8*a* and 8*b*, holding frames 1001, 2001 of the fourth embodiment (FIG. 8 *a*) and the fifth embodiment (FIG. 8 *b*) are each illustrated with a module 2 that is inserted and fixed in place and a module 2 which is not yet or no longer fixed.

Modules 2 have latching lugs 21, which are each designed to be received in latching windows 1111, 2111 of holding frames 1001, 2001, so that modules 2 are held in holding frames 1001, 2001 by the interaction of latching lugs 21 and latching windows 1111, 2111.

FIGS. 9*a*-9*d* show schematic cross-sectional views of the holding frames from FIGS. 7*a* and 7*b*, and FIGS. 10*a*-10*d* show further schematic cross-sectional views of the holding frames from FIGS. 7*a* and 7*b*.

FIGS. 9 *b*), 9 *d*), 10 *b*) and 10 *d*) each show an enlarged view of a part marked in the views shown in FIGS. 9 *a*), 9 *c*), 10 *a*) and 10 *c*).

Each of the Figures shows parts of base frame 1010, 2010 and flange parts 1011, 2011 attached thereto, with the cross-sectional plane running through a latching window 1111, 2111 in each case.

In FIGS. 9 *b*), 9 *d*), 10 *b*) and 10 *d*), it can be seen that flange part 1011, 2011 extends from a step 1109, 2109 on the outer face 1101, 2101 of base frame 1010, 2010 in the insertion direction (see FIG. 8), around the lower edge 1102, 2102 of the base frame 1010, 2010 and then along the inner face 1103, 2103 of the base frame 1010, 2010 in the opposite direction to the insertion direction (see FIG. 8).

The edge 1104, 2104 of the base frame 1010, 2010 opposite the lower edge 1102, 2102 comprises a latching window portion 1105, 2105 for each latching window region 1107, 2107 of flange part 1011, 2011, and a clasping portion 1106, 2106 corresponding to each holding region 1108, 2108 of flange part 1011, 2011.

When latching window region 1107, 2107 is deformed, it rests against latching window portion 1105, 2105, thus resulting in a corresponding degree of stiffness due to the lever arm that ensues.

Holding region 1108, 2108 extends in the respective clasping portion 1106, 2106 around the edge 1104, 2104 of base frame 1010, 2010, with the result that the respective flange part 1011, 2011 is fixed form-fittingly to base frame 1010, 2010.

In the fourth embodiment (see in particular FIG. 9 *b*) and FIG. 10 *b*)), guide portion 1114 is joined by webs to the rest of flange part 1011, said webs each having two kinks (or arcs) in the region of edge 1104/1105, so that they extend, like guide portion 1114 also, above the kinks in the vicinity of and approximately parallel to the outer face 1101 of base frame 1010. In the fifth embodiment also (see FIGS. 9 *d*) and 10 *d*), in particular), guide portion 2114 is joined by webs to the rest of flange part 2011. As was already the case in the fourth embodiment, the webs in the region of edge 2104/2105 kink initially towards the outer face 2101 of base frame 2010. Unlike in the fourth embodiment, the webs then extend slantingly at first, when not under load, towards outer face 2101, with another kink being provided at the transition to guide portion 2114, such that a plane defined by the webs and a plane defined by guide portion 2114 are at an obtuse angle to each other.

Unlike in the fourth embodiment, the latching window portion 2105 of the edge of base frame 2010 has a projection that projects in the opposite direction to the insertion direction, in contrast to the part of latching window portion 2105 with which the webs of latching window region 2107 come into contact. Latching lug 21 abuts this projection when module 2 is in the inserted state. Latching lug 21 is thus held between the projection in base frame 2010 and guiding portion 2114 as the upper boundary of latching window 2111. This has the advantage that any stress on holding frame 2001, due, for example, to a pull on module 2 in the insertion direction, is absorbed by base frame 2010, which is mechanically more robust, and not, for example, by flange part 2011 made, for example, of sheet metal.

Figure 11:
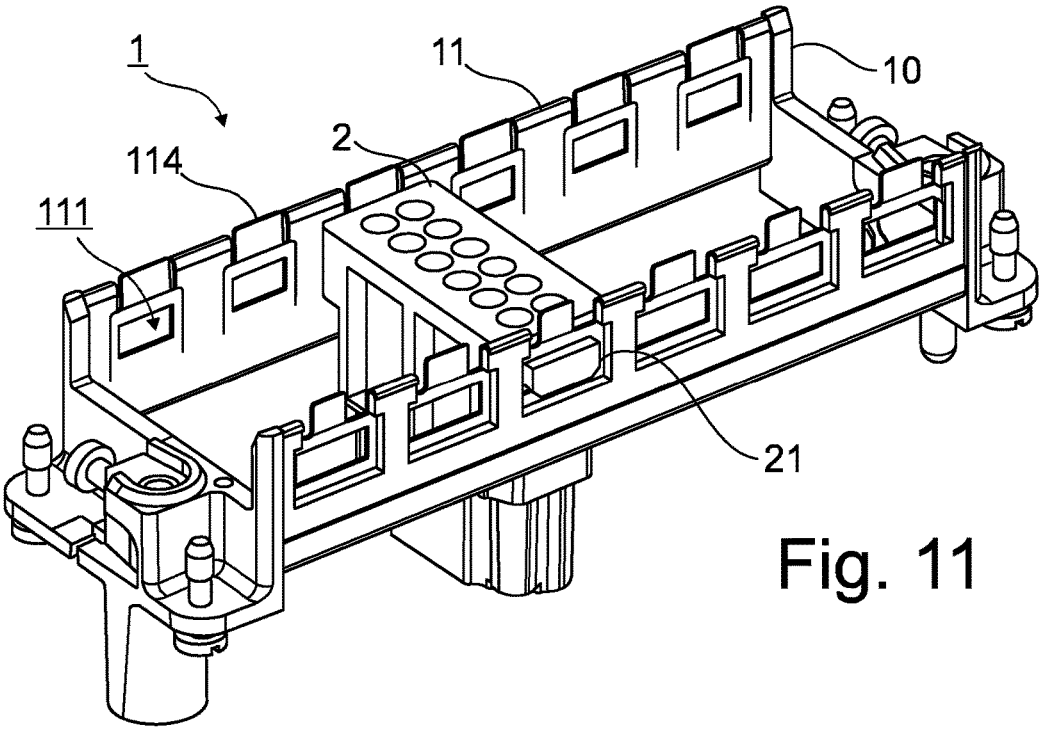
FIG. 11 shows a schematic view of a modification of the first embodiment of the holding frame according to the invention.
Figure 12:
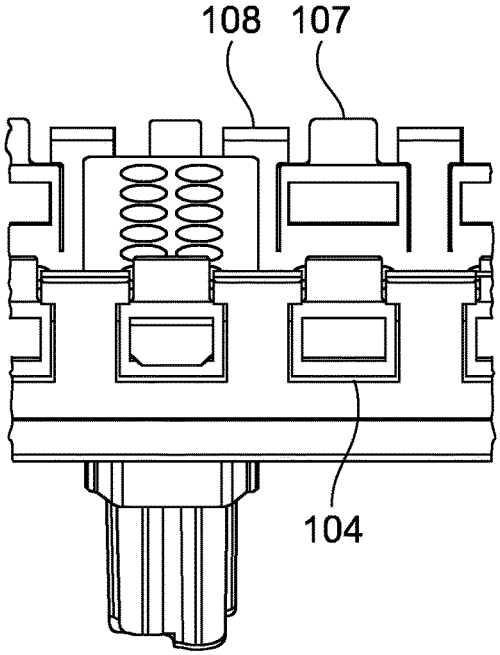
FIG. 12 shows another schematic view of the modification shown in FIG. 11.
Figure 13:
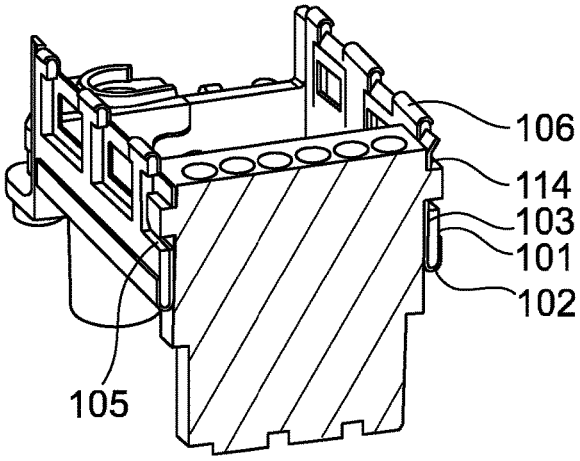
FIG. 13 shows a schematic cross-sectional view of the modification illustrated in FIGS. 11 and 12.

FIG. 11 shows a schematic view of a modification of the first embodiment of the holding frame according to the invention, and FIG. 12 shows another schematic view of said modification. FIG. 13 shows a cross-sectional view of the modification illustrated in FIGS. 11 and 12.

As already discussed above with reference to the first embodiment, flange parts 11 of holding frame 1 each extend along an outer face 101 of base frame 10 in the insertion direction, around the lower edge 102 of base frame 10 and then along the inner face 103 of base frame 10 and beyond edge 104 in the opposite direction to the direction of introduction or insertion.

Similarly to the fourth and fifth embodiment, edge 104 has a latching window region 105 and a clasping portion 106, with a latching window 111 being provided above each latching window portion 105 of edge 104.

In FIGS. 11-13, an inserted module 2 can be seen, the latching lugs 21 of which are received in the fixed state in a matching latching window 111.

Similarly again to the fourth and fifth embodiment, flange parts 11 each comprise a plurality of latching window regions 107 and a plurality of holding regions 108, and here, too, holding regions 108 each extend around the clasping portion 106 of edge 104 of base frame 11.

Flaps 113, described above, have the same function as latching window regions 107, but one difference from the embodiment illustrated in FIGS. 4 and 5 is that, between latching window regions 107, not just one slot 112 is provided in each case, but also and additionally a holding region of flange part 11.

Even if different aspects or features of the invention are shown in combination in the Figures, it is clear to a person skilled in the art, unless otherwise specified, that the combinations shown and discussed are not the only ones possible. More particularly, it is possible to swap corresponding units or groups of features from different embodiments.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame for a plug connector for receiving similar and/or different modules, comprising:

a base frame which defines a plane transverse to an insertion direction of a module into the holding frame, and at least two flange parts, which are attached to the base frame opposite each other, wherein each flange part extends outside the base frame along an outer face of the base frame in the insertion direction, around a lower edge of the base frame, inside the base frame along an inner face of the base frame in the opposite direction to the insertion direction and beyond an edge of the base frame in the opposite direction to the insertion direction, wherein each flange part has at least one latching window, in the region extending beyond the edge of the base frame, as a latching element for receiving a latching lug of the module, wherein the flange parts are designed to undergo elastic bending and deformation between an insertion state, which allows the module to be inserted into the holding frame in the insertion direction, and a holding state in which an inserted module is fixed in place at least along the insertion direction by the latching lug engaging into the latching window.

2. The holding frame according to claim 1, wherein the base frame, on the one hand, and the flange parts, on the other hand, are made at least partly of different materials.

3. The holding frame according to claim 1, wherein the base frame is made at least partly by metal die casting.

4. The holding frame according to claim 1, wherein the flange parts have or consist of a resilient metal plate and are made at least partly by die forming.

5. The holding frame according to claim 1, wherein the flange parts are attached form-fittingly, force-lockingly and/or by material bonding to the inner face and/or to the outer face of the base frame.

6. The holding frame according to claim 1, wherein each flange part has at least one slot extending in the insertion direction, which separates two flaps of the flange part from each other in at least part of the region extending beyond the edge, each flap having at least one latching window as a latching element for receiving a latching lug of the module.

7. The holding frame according to claim 6, wherein the slot extends into the region of the flange part, which extends along the inner face of the base frame.

8. The holding frame according to claim 1, having at least four flange parts, each two of which are attached adjacently to each other to one side of the base frame.

9. The holding frame according to claim 1, wherein at least one flange part has a guide portion, which allows the module to be guided between the opposite flange parts when the module is being inserted and/or along which the latching lug of the module is guided on insertion, in order to deform the flange part into the insertion state.

10. The holding frame according to claim 1, wherein at least the region of each flange part extending along the inner face of the base frame is designed to contact the inserted module at least partly to fix it in place between the opposite flange parts.

11. The holding frame according to claim 10, wherein at least the region of each flange part extending along the inner face of the base frame has a spring portion, which is designed to contact the inserted module and to exert pressure in the direction of the inner face of the base frame.

12. The holding frame according to claim 10, wherein at least the region of each flange part extending along the inner face of the base frame is designed to contact the surface of the inserted module continuously in the insertion direction.

13. The holding frame according to claim 1, wherein each flange part has one or more latching window regions extending beyond a latching window portion of the edge of the base frame and having the at least one latching window, and one or more holding regions, each extending around a clasping portion of the edge of the base frame and fixing the flange part form-fittingly to the base frame.

14. The holding frame according to claim 13, wherein the clasping portion of the edge of the base frame is spaced further apart in the insertion direction from the lower edge of the base frame than the latching window portion of the edge of the base frame.

15. The holding frame according to claim 1, wherein the flange parts are designed such that the holding frame does not exceed a total predetermined width at least in a region from a lower edge thereof to a predetermined height, also when the flange parts are in the insertion state, wherein the total predetermined width is equal to the total width of the holding frame below the latching window.

16. The holding frame according to claim 1, wherein each outer face of the base frame has a step, in particular such that the outer surfaces of the flange parts extending outside the base frame along the outer face of the base frame are aligned with a respectively exposed outer surface of the base frame, or the outer surfaces of the flange parts extending outside the base frame along the outer face of the base frame are offset in a direction of the interior of the base frame relative to the respectively exposed outer surface of the base frame.

17. A method of populating a holding frame for a plug connector for receiving similar and/or different modules with a module, said method comprising:

inserting the module into a base frame, which defines a plane transverse to an insertion direction of the module into the holding frame, wherein the module is inserted between at least two flange parts, which are attached to the base frame opposite each other, wherein each flange part extends outside the base frame along an outer face of the base frame in the insertion direction, around a lower edge of the base frame, inside the base frame along an inner face of the base frame in the opposite direction to the insertion direction and beyond an edge of the base frame in the opposite direction to the insertion direction, wherein each flange part has at least one latching window, in the region extending beyond the edge of the base frame, as a latching element for receiving a latching lug of the module, wherein insertion includes elastic bending of the flange parts, which are supported by the base frame, into an insertion state, wherein the method includes elastic deformation of the flange parts back from the insertion state to a holding state, and wherein the inserted module is fixed in the holding state at least along the insertion direction by the latching lug engaging into the latching window.

* * * * *